United States Patent [19]

Camenisch et al.

[11] 4,386,148

[45] * May 31, 1983

[54] PROCESS FOR IMPROVING THE PHOTOELECTRIC PROPERTIES OF A LAMINATED CHARGE IMAGE CARRIER

[75] Inventors: Hans Camenisch, Chur; Jarmila Bachner, Egg; Wolfgang F. Berg, Forch, all of Switzerland

[73] Assignee: Elfotec A.G., Zumikon, Switzerland

[ * ] Notice: The portion of the term of this patent subsequent to Dec. 22, 1998, has been disclaimed.

[21] Appl. No.: 262,009

[22] Filed: May 8, 1981

Related U.S. Application Data

[62] Division of Ser. No. 546,816, Feb. 3, 1975, Pat. No. 4,307,166.

[30] Foreign Application Priority Data

Feb. 1, 1974 [DE] Fed. Rep. of Germany ..... 2404921

[51] Int. Cl.[3] ..... G03G 5/04; G03G 5/08

[52] U.S. Cl. ..... 430/131; 430/61

[58] Field of Search ..... 430/61, 31, 57, 131

[56] References Cited

U.S. PATENT DOCUMENTS

| | | | |
|---|---|---|---|
| 2,986,467 | 5/1961 | Kostelec et al. | 96/1.8 |
| 2,997,387 | 8/1961 | Tanenbaum | 96/1.8 |
| 3,573,906 | 4/1971 | Goffe | 96/1.8 |
| 3,620,723 | 11/1971 | Yamaguchi et al. | 430/61 |
| 3,684,548 | 8/1972 | Contois | 430/61 |
| 3,723,110 | 3/1973 | Goffe | 96/1.5 |
| 3,740,217 | 6/1973 | Gramza et al. | 96/1.8 |
| 3,787,208 | 1/1974 | Jones | 96/1.8 |
| 3,928,034 | 12/1975 | Regensburger | 96/1.5 |
| 3,953,207 | 4/1976 | Horgan | 96/1.5 X |
| 4,307,166 | 12/1981 | Camenisch et al. | 430/61 |

FOREIGN PATENT DOCUMENTS

| | | | |
|---|---|---|---|
| 7635402 | 2/1971 | Belgium | 96/1.5 |
| 1106562 | 3/1968 | United Kingdom | 430/61 |

OTHER PUBLICATIONS

Hoegl, on Photoelectric Effects in Polymers & Their Sensitization by Dopants, Journal of Phys. Chem., vol. 69, #3, 3/1965, pp. 755–759, 761–766.

*Primary Examiner*—John E. Kittle
*Assistant Examiner*—John L. Goodrow
*Attorney, Agent, or Firm*—Arnstein, Gluck & Lehr

[57] ABSTRACT

A process for improving the photoelectric properties of a laminated charge image carrier. In the process, a coating composition is prepared containing an insulating material which is doped by admixing a sensitizer and a coating of the doped composition is applied to a substrate to form a doped insulating layer. A photoconductive layer containing the sensitizer is then applied to the doped insulating layer.

2 Claims, No Drawings

PROCESS FOR IMPROVING THE PHOTOELECTRIC PROPERTIES OF A LAMINATED CHARGE IMAGE CARRIER

This application is a division of application Ser. No. 546,816, filed Feb. 3, 1975, now U.S. Pat. No. 4,307,166.

The present invention relates to a process for improving the photoelectric properties of a laminated charge image carrier.

In electrophotography charge image carriers are used for producing an image. Such a charge image carrier has for instance a photoconductive layer which is arranged on an electrically conductive substrate and is first of all charged electrically to a given voltage, for instance about 350 volts, whereupon it is exposed in accordance with a master copy and thereby discharged in accordance with the picture. In this way a latent electrostatic charge image is produced on the charge image carrier and is then developed directly on the photoconductive layer or after its transfer to another support. For the development electrically charged particles of toner are for instance employed.

One important photoelectric property of such a charge image is its sensitivity. By this there is meant its discharge by exposure.

For special purposes, for instance in order to be able to charge a charge image carrier both negatively and positively or in order to obtain a given saturation voltage of the charge image carrier by means of a photoconductive layer which is thinner than otherwise customary or in order to obtain a charge image carrier which can be used repeatedly or, finally, in order to be able to use an aqueous dispersion of the photoconductive pigment in a binder for the production of the photoconductive layer of the charge image carrier it has proved advantageous to arrange an insulating layer between the conductive substrate of the charge image carrier and its photoconductive layer.

This insulating layer has a detrimental effect on the photoelectric sensitivity of the image charge carrier produced with it since the insulating layer impedes or impairs the dischargeability of the charge image carrier.

The object of the present invention is accordingly to provide a method of improving the photoelectric properties of a laminated charge image carrier having such an insulating layer, i.e., to improve its sensitivity or in other words to make the charge image carrier more easily dischargeable.

The present invention relates to a process for improving the photoelectric properties of a laminated charge image carrier provided with an insulating layer between the substrate and the photoconductive layer, which process is characterized by the fact that upon the production of the charge image carrier the insulating layer applied to the substrate is doped prior to its coating with the material resulting in the photoconductive layer.

The invention will be explained below on basis of an example.

On a substrate known from electrography, for instance, a metal foil or a so-called conductivity paper, there is applied an insulating layer. This can be done by coating, rolling or spraying, etc. a material forming an electrically insulating layer onto the substrate. Suitable materials are, for instance, acrylic polymers, polyvinylidene chloride copolymers, polyamides, methacrylates and styrene acrylates.

For the doping of the insulating layer, the donor may be introduced either into the preformed insulating layer or else into the coating composition intended for this.

For example, this doping of the insulating layer can be effected by exposing the surface thereof to acid vapors. However, thin layers which form dipole charges, for instance iodine sublimation, can also be used in order to obtain the desired doping. The diffusion of sensitizer dyestuffs of known type or of pigments, including photopigments, can also be employed for the said purpose of doping.

For example, a sensitizer dye can be introduced into a dielectric which is still liquid and the insulating layer thus produced in known manner.

By the use of the said doping of the insulating layer with a donor, it has been possible substantially to improve the sensitivity and/or dischargeability of a charge image carrier provided therewith, as can be noted from the following:

1. Charge image carrier with non-doped insulating layer:
   Charging to 500 volts.
   Half life of the voltage upon exposure with a light intensity of 10 $\mu W/cm^2$ is 3.9 seconds.
2. Charge image carrier with doped insulating layer:
   Charging to 425 volts;
   Half life of the voltage with the same exposure is 1 second.

A few examples of the carrying out of the process of the invention are given below.

FIRST EXAMPLE

An insulating layer of the aforementioned type is formed on the substrate by brushing on a suitable coating composition and drying it. The free surface of the insulating layer is exposed to acid or alkaline vapors, for instance acetic acid or ammonia. The photoconductive layer is applied over the insulating layer which has been treated in this manner, for instance by application of a corresponding coating composition followed by drying.

SECOND EXAMPLE

A first insulating layer of the aforementioned type is applied to the substrate and dried. Over this there is applied a second additional insulating layer containing about 10% photopigments. This further insulating layer forms an intimate bond with the first insulating layer. In this way one obtains a total insulating layer whose uppermost part is permeated by photopigments or ZnO.

THIRD EXAMPLE

An insulating layer of the above-mentioned type is applied to the substrate and dried. A halogen, for instance iodine, is sublimated onto this insulating layer, for instance by heating solid iodine in the direct vicinity of the insulating layer.

The photoconductive layer is applied to this doped insulating layer by application of a suitable coating composition followed by drying.

FOURTH EXAMPLE

An insulating layer is applied to the substrate, at least one sensitized or unsensitized photopigment being added to the coating composition, for instance in a quantity ratio of about 10%.

The photoconductive layer is applied to the dried insulating layer in the manner described in Example 3.

FIFTH EXAMPLE

To the coating composition for the insulating layer consisting of polyvinylidene chloride copolymer there are admixed 5 parts of phosphoric acid, referred to the solid copolymer. After the doped insulating layer has been dried, the photoconductive layer is applied in the manner set forth in Example 3.

SIXTH EXAMPLE

At least one sensitizer of the same type as provided for the following photoconductive layer is added in a concentration of 1000–5000 ppm to the coating composition for the insulating layer of polyvinylidene chloride copolymer. After the doped insulating layer has been dried, the photoconductive layer is applied in the manner indicated in Example 3.

What is claimed is:

1. A process of improving the photoelectric properties of a laminated charge image carrier provided with an insulating layer between a substrate and a photoconductive ZnO layer, wherein the photoconductive ZnO layer is prepared from a coating composition containing at least one sensitizer, comprising the steps of:

(A) preparing a coating composition containing an insulating material, (B) doping the coating composition by admixing between 1000 and 5000 ppm of said at least one sensitizer to the coating composition for the insulating layer, (C) applying a coating of the doped coating composition to the substrate to form a doped insulating layer, and (D) applying on said doped insulating layer a photoconductive layer comprising ZnO photopigment and the said at least one sensitizer.

2. Process according to claim 1, wherein said at least one sensitizer is a sensitizer for ZnO.

* * * * *